US005090663A

United States Patent [19]

Crutchfield et al.

[11] Patent Number: 5,090,663

[45] Date of Patent: Feb. 25, 1992

[54] STAPLE REMOVER

[75] Inventors: H. Carl Crutchfield; Stephen M. Shomberger, both of Cordova; Mark T. Wedell, Memphis, all of Tenn.; Michael D. Breedlove, Michigan City, Miss.

[73] Assignee: The Troxel Company, Moscow, Tenn.

[21] Appl. No.: 628,188

[22] Filed: Dec. 13, 1990

[51] Int. Cl.[5] ..... B25C 11/00

[52] U.S. Cl. ..... 254/28

[58] Field of Search ..... 254/28; 227/63

[56] References Cited

U.S. PATENT DOCUMENTS

| | | | |
|---|---|---|---|
| D. 33,820 | 1/1901 | Faurest . | |
| D. 183,081 | 6/1958 | Barton . | |
| D. 229,282 | 11/1973 | Covey . | |
| D. 263,551 | 3/1982 | Dale . | |
| D. 295,362 | 4/1988 | Furman . | |
| 1,410,426 | 3/1922 | Torgerson | 254/28 |
| 2,563,227 | 8/1951 | Emery . | |
| 2,675,989 | 4/1954 | Vogel | 254/28 |
| 3,625,482 | 12/1971 | Viel | 254/28 |
| 3,698,689 | 10/1972 | Poskin . | |
| 3,761,057 | 9/1973 | Nembhard et al. | 254/28 |
| 3,825,226 | 7/1974 | Appleman . | |
| 4,049,236 | 9/1977 | Grill et al. . | |
| 4,205,823 | 6/1980 | Goldy . | |
| 4,553,737 | 11/1985 | Yi | 254/28 |
| 4,930,749 | 6/1990 | Lawrence . | |

FOREIGN PATENT DOCUMENTS

| | | | |
|---|---|---|---|
| 2223978 | 4/1990 | United Kingdom | 254/28 |

*Primary Examiner*—Robert C. Watson

*Attorney, Agent, or Firm*—Luedeka, Hodges, Neely & Graham

[57] ABSTRACT

The specification discloses a staple remover for removing staples from an object. In one embodiment, the staple remover comprises a plastic handle having an elongate gripping portion, a projecting head on a first end of the gripping portion, a cavity extending through the gripping portion from a second end thereof to an opening to the second end, and a passageway communicating between the cavity and the exterior of the handle at a position adjacent the projecting head. The gripping portion and the head are integrally formed together as a unitary, one-piece construction. As a second part, the staple remover includes a metallic clip having a first end which extends into the passageway so that the clip is supported on the handle. The clip has a second end which projects out of the passageway into the head and which is configured to provide a projecting end for being urged under a staple to enable removal of the staple from the object by the application of a force through the clip from the handle. The clip is also provided by a single, unitary construction. The clip and handle are configured to provide for insertion of the clip into the passageway through the cavity of the handle which enables an efficient mode of assembly of the device.

16 Claims, 3 Drawing Sheets

STAPLE REMOVER

This invention relates generally to the removal of U-shaped staples from stapled objects and more particularly relates to tools used for removing such staples.

A known type or class of staple remover includes a handle with a tipped shank protruding from one end of the handle for insertion beneath the bridge of a U-shaped staple as the handle of the tool is gripped by the user. The staple is pried from the object by wedging the tip under the staple bridge and rocking the handle down. Examples of staple removal tools such as aforedescribed are shown and described in U.S. Pat. Nos. 3,825,226, 4,049,236, 4,930,749 and 4,219,187.

It is an object of the present invention to provide a new and improved staple remover of the aforedescribed class.

Another object of the present invention is to provide a staple remover of the character described which holds staples that have been previously removed in a secure arrangement for subsequent disposal.

Still another object of the present invention is to provide a staple remover of the character described which reduces the likelihood that the surface of the object from which a staple is being removed will be damaged by the device.

Yet another object of the invention is to provide a staple remover which overcomes deficiencies in existing staple removers.

A further object of the present invention is to provide a staple remover of the character described which is uncomplicated in construction, easy to use and effective in operation.

The invention relates to a staple remover for removing a U-shaped staple from an object. In general, and in accordance with a preferred embodiment, the staple remover comprises an elongated handle for enabling gripping of the staple remover by a user. A head projects from one end of the handle and a clip is supported atop the head for being supportably inserted beneath a staple to enable its removal from the object by the application of a force on the clip through the supporting head. The clip includes means defining a magazine for storage of removed staples and gate means for permitting entry of staples to the magazine as staples are undergoing a process of removal from the object, the gate means restricting displacement of removed staples out of the magazine.

In accordance with one form of the invention, the staple remover comprises means providing an elongated handle adapted to be grasped by the hand of a user and an integrally formed wedge-shaped head projecting from one end of the handle. A clip is supported on the handle and has an upper and a lower prong. The lower prong of the clip is supported on the head and has an upper surface, an outboard end edge, and two opposite side edges which extend rearwardly of the lower prong from its end edge so that the end edge may be urged between a staple and a stapled object for removing the staple from the stapled object with the bridge of the removed staple extending across the lower prong of the clip and the legs of the staple depending from the side edges thereof. The upper prong of the clip overlies the upper surface of the lower prong in spaced relation to provide a staple storage magazine therebetween and has a finger adjacent an outboard end thereof which is disposed closely adjacent to the upper surface of the lower prong so as to engage the bridge of a staple undergoing a process of removal from the object by the urging of the end edge of the lower prong between the staple and the stapled object. The upper prong resiliently yields in response to the urging of the finger against the bridge of the staple to cause the finger to move away from the lower prong to permit movement of the bridge of the staple along the lower prong past the finger and into the magazine.

One advantageous feature of the remover enables secure storage of removed staples within the magazine by ensuring that the width of the head beneath the lower prong adjacent the magazine is such that legs of removed staples which depend from the side edges of the lower prong engage the head to restrict movement of staples in the magazine. This reduces the tendency of staples to fall out of the magazine during the rigors of normal use.

In accordance with still another form of the invention, a staple remover is provided for removing staples from an object and comprises a plastic handle having an elongate gripping portion, a projecting head on a first end of the gripping portion, and into a passageway extending into the gripping portion from the exterior of the handle at a position adjacent the projecting head. The gripping portion and the head are integrally formed together as a unitary, one-piece construction. The staple remover further includes a metallic clip having a first end which extends into the passageway so that the clip is supported on the handle. The clip has a second end which projects out of the passageway onto the head and which is configured to provide a projecting end for being urged under a staple to enable removal of the staple from the object by the application of a force through the clip from the handle. Like the handle, the clip is provided by a single, unitary construction. In accordance with this aspect of the invention, the staple remover includes means for lockably inserting the clip into the passageway which enables an efficient and low cost method of assembly of the device.

These and other features and advantages of the invention will now be further described in further detail with reference to the accompanying drawings in which:

FIG. 1 is a perspective view of a staple remover embodying features of a preferred embodiment of the present invention;

FIG. 1*a* is an elevational view of a type of staple capable of being removed from a stapled object with the FIG. 1 staple remover;

FIG. 1*b* is an elevational view of a staple of the type shown in FIG. 1*a* and illustrating a common configuration of the staple after it is removed from the object;

Figure 10A:
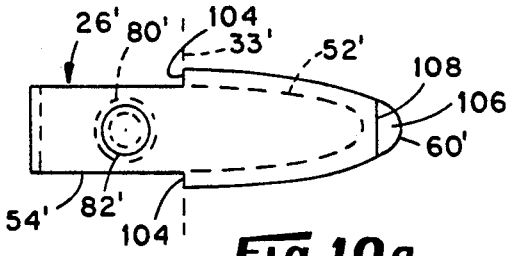
Figure 10B:
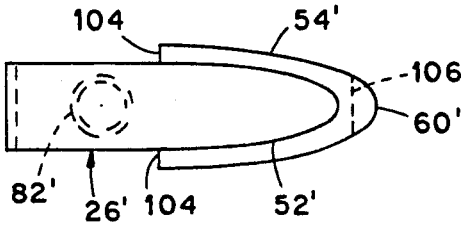
Figure 11:
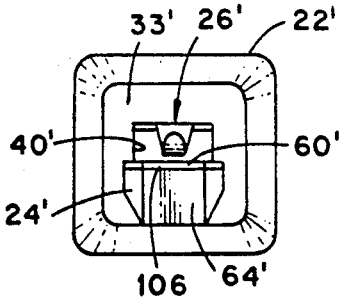
Figure 12A:
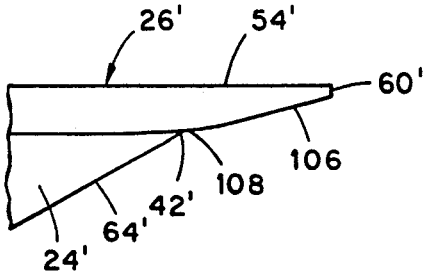
Figure 12B:
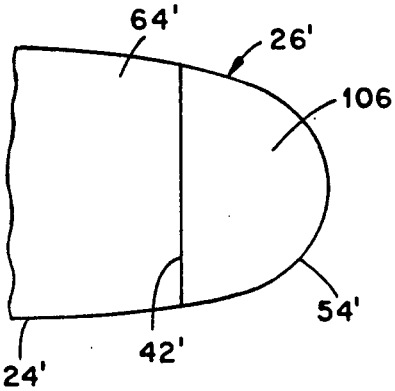

FIGS. 10*a* and 10*b* are bottom and top views, respectively, illustrating features of a portion of a staple puller in accordance with an additional embodiment of the invention;

FIG. 11 is a front end view illustrating other features of the embodiment of the staple puller shown in FIGS. 10*a* and 10*b*; and FIGS. 12*a* and 12*b* are fragmentary side and bottom views, respectively, illustrating features of the embodiment of FIGS. 10*a* and 10*b*.

Figure 1:
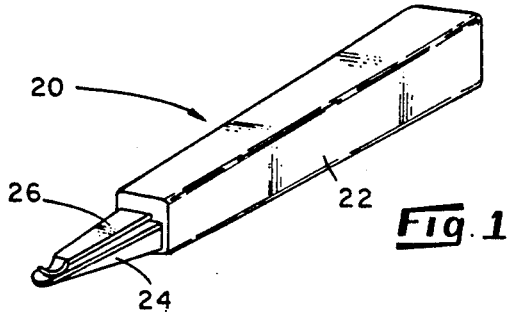
Figure 1B:
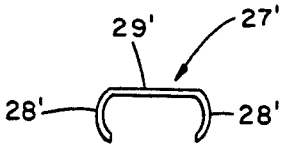

Turning now to the drawings and considering first FIG. 1, there is illustrated an embodiment, indicated at 20, of a staple remover for removing a U-shaped staple from a stapled object and incorporating features of the present invention. The staple remover 20 includes an elongate grip or handle 22, a wedge-shaped head 24 extending from one end of the handle 22, and a clip 26 positioned on the head 24.

Figure 1A:
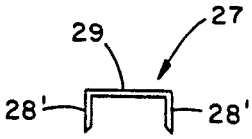

FIG. 1*a* illustrates a metal staple 27 of a type which can be readily removed from a stapled object with the staple remover 20. The staple 27 is U-shaped and includes a pair of parallel depending legs 28 which are joined at their upper ends to a bridge 29. When the staple 27 is used to staple an object, the legs 28 project through the object surface leaving the bridge 29 exposed in overlying relationship with the object surface. As will be apparent herein, the staple 27 is removed from the stapled object as the head 24 and the overlying clip 26 of the staple remover 20 are urged between the bridge and the underlying surface of the stapled object.

Figure 2:
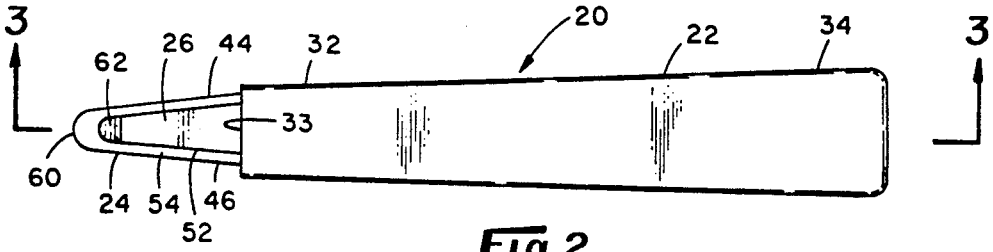
FIG. 2 is a top plan view of the FIG. 1 staple remover.
Figure 3:
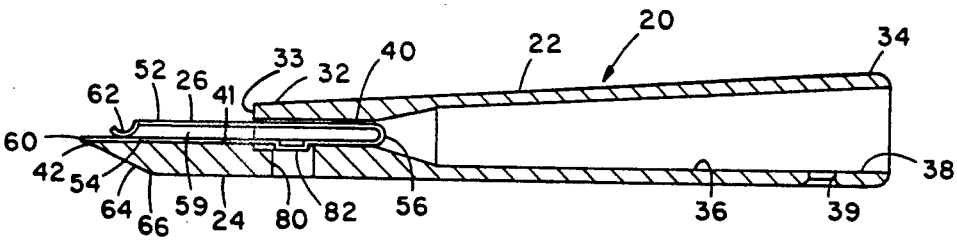
FIG. 3 is a cross-sectional view taken along line 313 3 of FIG. 2.
Figure 4:
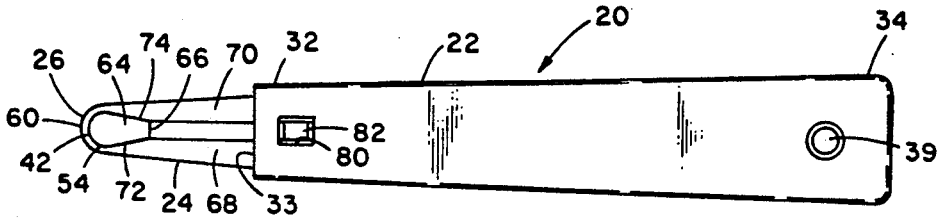
FIG. 4 is a bottom plan view of the FIG. 1 staple remover.
Figure 5:
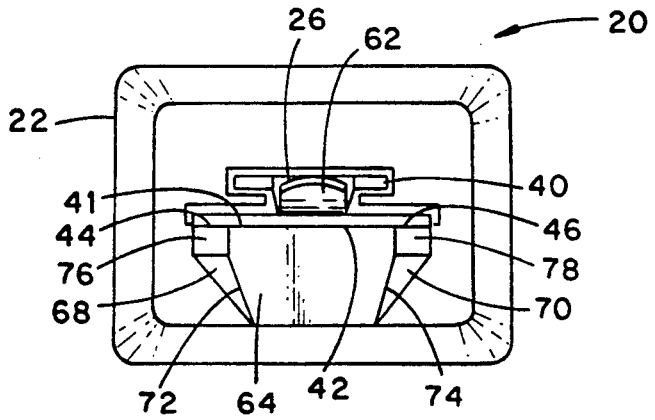
FIG. 5 is a front elevational view of the FIG. 1 staple remover, drawn to a larger scale.

With reference to FIGS. 2–5, the handle 22 has a forward end 32 terminating in a generally vertical front face 33 and an opposite rearward end 34, and is shaped so as to be comfortably grasped by the hand of a user. In this connection, each transverse cross-section of the handle 22 is generally square with rounded corners so that the outer surface of the handle 22 is substantially devoid of sharp edges. As best shown in FIG. 3, the handle 22 is preferably hollow so as to provide an interior cavity 36 along a major portion of its length. The cavity 36 communicates exteriorly of the handle 22 through the rearward end 34 at a relatively large opening 38. In order that the staple remover 20 may be hung from a suitable support, such as a hanger protruding from a vertical wall, a bore 39 is provided in the underside of the handle 22 adjacent the rearward end 34. There is also provided in the handle 22 a narrow passageway 40 adjacent the forward end 32 which communicates between the face 33 and the interior cavity 36. As best shown in FIG. 5, the passageway 40 is I-shaped in cross-section.

The head 24 has a relatively flat upper surface 41 which extends forwardly of the front face 33 of the handle 22. The surface 41 is disposed generally parallel to the longitudinal axis of the handle 22 at a position slightly below the longitudinal centerline of the handle, in approximate horizontal alignment with the bottom surface of the passageway 40. The head 24 further includes an end edge 42 and two opposite side edges 44, 46 which extend rearwardly along the surface 41 from the end edge 42. The end edge 42 may be rounded in shape as it extends between the side edges 44, 46 and, as best shown in FIG. 2, the two side edges 44, 46 may diverge away from one another as a path is traced rearwardly along the head 24 from the end edge 42 thereof.

The clip 26 of the staple remover 20 is elongated in shape with a lower prong 54 supported on the upper surface 41 of the head 24. The lower prong 52 of the clip 26 is joined to an upper prong 52 at a bend 56, which is received within the passageway 40 communicating between the cavity 36 and the front face 33 of the handle 22. The upper and lower prongs 52, 54 of the clip 26 are generally flat, wide and thin, and are spaced apart a distance approximately equal to the thickness of the bridge 29 of the staple 27 to provide a storage magazine 59 over the head 24. As seen in FIG. 2, the upper prong 52 is preferably narrower and shorter than the lower prong 54, and is positioned in concentric, overlying relation with the lower prong.

The clip 26 is preferably an integral construction formed of a piece of spring steel folded upon itself at the bend 56 to provide the upper and lower prongs 52, 54. Alternately, the clip may be provided by resilient stainless steel material. The tension within the steel is preferably such that the upper and lower prongs 52, 54 are continuously resiliently urged away from each other against the top and bottom surfaces of the passageway 40, which in turn maintains the upper and lower prongs at the desired separation.

The lower prong 54 of the clip 26 terminates in an end edge 60 which is rounded as viewed from above in conformity with the shape of the end edge 42 of the head 24, and which is disposed over and closely adjacent to, but slightly out from, the end edge 42. The upper prong 52 of the clip 26 is provided with a finger 62 at its outboard end which, in the illustrated embodiment, takes the form of a generally C-shaped bend on the tip of the upper branch 52 with the C facing upwardly. The finger 62 cooperates with the lower prong 54 in a manner to be described to provide storage of removed staples in the magazine 59 over the head 24.

The head 24 is provided on its underside with a bearing surface 64 which slopes down and away from the end edge 42 at a preferred angle of about 30° with respect to the upper surface 41. A shoulder 66 extends across the underside of the head 24 to provide the rearward edge of the bearing surface 64. As shown in FIG. 5, the head 24 is also provided with downwardly and forwardly converging side surfaces 68 and 70 which intersect the plane of the bearing surface 64 along front edges 72 and 74. The side surfaces 68 and 70 are preferably disposed at an angle of about 70° with respect to the plane of the upper surface 41 of the head 24, and may be separated therefrom by relatively short generally vertical side walls 76 and 78, respectively, which converge forwardly to the end edge 42 of the head.

With continuing reference to FIG. 5, it is seen that the lower prong 54 of the clip 26 is relatively wide as compared to the upper prong 52 and that the I-shaped passageway 40 has a cross-section that generally accommodates the width and thickness of the prongs while supporting the prongs against sidewise or vertical movement within the handle 22. Moreover, the bottom or lower surface of the passageway 40 is provided with a square-shaped detent 80 and the lower prong 54 of the clip 26 contains a projection 82 from its underside in the form of a square punch that fits into the detent to restrict lengthwise movement of the clip in the passageway. Alternately, the punch and detent may be rounded in shape. Overall, then, there is provided a very secure arrangement of the clip 26 within the handle 22 and a very reliable and firm positioning of the lower prong 54 of the clip upon the upper surface 41 of the head 24 to facilitate intended use of the device for removal of staples.

As shown in FIG. 3, the finger 62 on the upper prong 52 of the clip 26 is spaced back from the end edge 60 of the lower prong 54. The finger 62 either contacts or is located at a sufficiently small distance from the surface of the lower prong 54 so that the finger will firmly engage the bridge of a staple moving across the surface of the lower prong. However, the resiliency of the upper prong 52 is such that the upper prong and its appended finger 62 will yield up and away from the lower prong 54 in response to a force urging the finger 62 against the bridge of a staple so as to permit entry of the staples into the magazine 59. Yet, the biasing force will not be overcome by normal forces applied from staples queuing within the magazine 59 behind the finger 62, but can be easily overcome by upward hand manipulation of the upper prong 52 to permit emptying of staples from the magazine. In this manner, the upper and lower prongs 52 and 54 of the clip 26 cooperate to provide a gate means whereby staples are accepted into the magazine 59, and unintended displacement of staples from the magazine is avoided.

It will further be observed with respect to the arrangement of the clip 26 that the preferred spacing of the finger 62 from the end edge 60 of the lower prong 54 causes the staples which are undergoing a process of removal to progress along the surface of the lower branch 54 at least partially into the magazine 59 substantially in advance of complete withdrawal of the staples from the object. That is, the preferred arrangement of the finger 62 is such that the finger 62 has been fully displaced by the bridge of a passing staple and is at least beginning a return toward its resting position adjacent the surface of the lower prong 54 when the staple has been fully loosened from the object. Accordingly, there is very little possibility of a removed stapled avoiding capture into the magazine.

A further feature of the invention is that the head 24 provides full support to the lower prong 54 of the clip 26 both lengthwise and widthwise so that the lower prong rigidly or substantially inflexibly transmits forces to the staple undergoing removal, with no edgewise or endwise deflection of the lower prong. Thus, as illustrated in FIGS. 1 and 5, the width of the upper surface 41 of the head 24 corresponds substantially to and follows that of the lower prong 54 to provide firm, uniform support. Also, the end edge 60 of the lower prong 54 of the clip 26 projects only slightly beyond the end edge 42 of the head 24 so that the end edge 60 may be easily inserted between the bridge of the staple and the surface of the object, but there is still provided a firm support under the area of the lower prong 54 adjacent the end edge 60 by the thickening body of the head 24 extending down and away from the end edge 42.

The width of the head 24 between the side surfaces 68 and 70 under the lower prong 54 of the clip 26 provides another advantage related to the ability of the device to retain staples securely within the magazine 59. This stems from the fact that most staples are deformed somewhat upon removal from the object in which they are embedded. This deformation is particularly evident in the legs 28' of the removed staple 27' shown in the illustration of FIG. 1(*b*), where the legs 28' have assumed an inwardly curled shape after removal. The width of the head 24 beneath the lower prong 54 of the clip 26 results in frictional engagement of these inwardly turned legs 28' with the side surfaces 68 and 70 of the head and this engagement minimizes sidewise shifting on upward movement of queued staples in the magazine 59. The engagement also limits any tendency of the staples to rotate about the axis of the bridges which can allow the staples to drop out of the magazine when the devise is placed in certain orientations or subjected to the rigors of normal use.

An additional significant advantage associated with the invention is that the handle 22 and head 24 may be constructed as a single unit out of plastic, such as a polystyrene, through a molding or casting operation. Thus, the staple remover 20 may be provided by a two-part construction consisting of the handle 22 and head 24 as one integral part and the clip 26 as the other part. Also, it has been found that when the head 26 is constructed out of plastic or a material with a relatively low coefficient of friction, it will readily slide across the surface of a stapled object such as a paper sheet for purposes of removing a staple therefrom, and damage to the surface of the stapled object is minimized. Still another advantage of the invention relates to ease of manufacture and assembly owing to the two-part construction. The clip 26 and handle 22 may be pre-manufactured in essentially final form and the assembly of the two parts may be readily accomplished simply by inserting the clip 26, front end first, into the cavity 36 from the rear end 34 of the handle 22, with the upper and lower prongs 52, 54 compressed together and positioned to enter the back opening of the passageway 40. The clip 26 is then urged down the passageway 40 until the projection 82 snaps into the detent 80, which holds the clip 26 in final position as depicted in the drawings. This is a relatively simple procedure of assembly which lends itself to low cost, mass production techniques.

Figure 6:
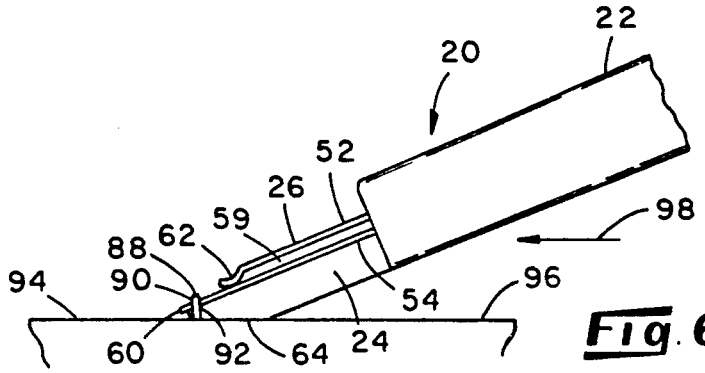
FIGS. 6–8 are fragmentary side elevational views illustrating sequential positions of the FIG. 1 staple remover when used to remove a staple from a stapled object.
Figure 7:
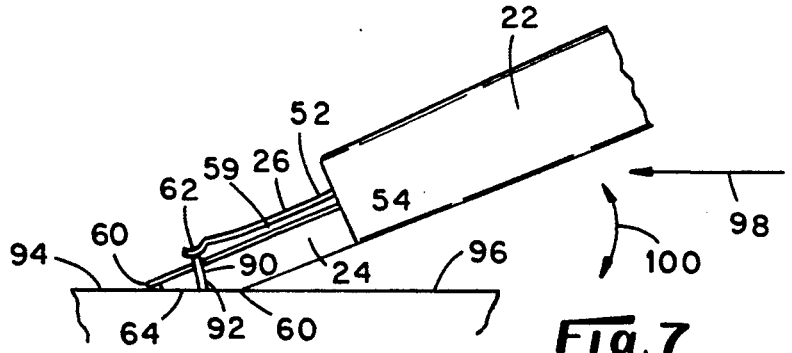
Figure 8:
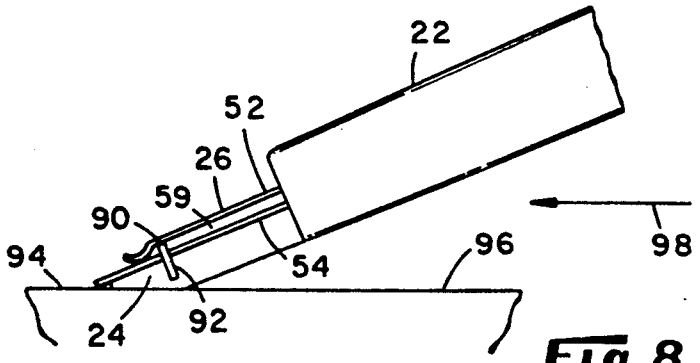

Various aspects of the staple remover 20 related to its use have been discussed in the foregoing. Reference will now be had to FIGS. 6 through 9 which illustrate a sequence of events associated with use of the device in a process of staple removing. Referring first to FIG. 6, the handle 22 is grasped with the hand and the end edge 60 of the clip 26 is urged beneath a bridge 88 of a U-shaped staple 90 having a pair of legs 92 which extend through the surface 94 of a stapled object 96. In this connection, the staple remover 20 is placed upon the object 86, such as a collection of paper sheets, so that the bearing surface 64 of the head 24 flatly engages the surface 94 and the end edge 60 of the clip 26 is urged in the direction of the arrow 98 (FIG. 9) between the bridge 88 and the surface 94. As the staple remover 20 continues to be urged in the direction of arrow 98, the head 24 and lower prong 54 of the clip 26 are wedged between the staple bridge 88 and the object surface 94 so that the legs 92 of the staple 90 are forcibly withdrawn upwardly, out of the object 86. Continued urging of the staple remover 20 in the direction of the arrow 98 causes the finger 62 of the upper prong 52 of the clip 28 to move across the staple bridge 88, as shown in FIG. 7, and the legs 92 of the staple 90 are thereafter completely withdrawn from the object 86 as shown in FIG. 8.

As described earlier, the staple bridge 88 passes between the finger 62 and lower prong 54 of the clip 26 with the upper prong 52 resiliently yielding in an upward direction to accommodate passage of the staple 90 into the magazine 59. Thereafter, the memory of the clip 26 returns the finger 62 to its resting position in close adjacency or engagement with the lower prong 54. If desired, the rear end of the handle 22 can be pivoted upwardly or downwardly about the shoulder 66 in the direction of the arrow 100 of FIG. 7 so that the shoulder 66 or end edge 60 of the clip 26 is utilized as a fulcrum to forcibly lift the staple 90 from the object 96 in a prying action, as the head 24 and clip 26 are progressively wedged under the staple bridge 88.

Figure 9:
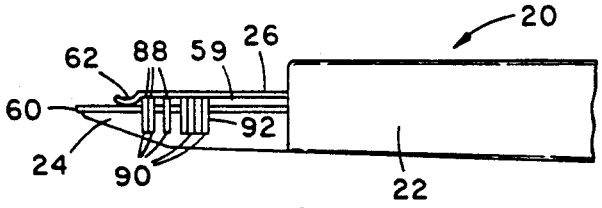
FIG. 9 is a fragmentary side elevational view illustrating the FIG. 1 staple remover shown with its storage magazine holding a plurality of staples which have been removed with the staple remover.

The staple queuing and storage features of the invention are illustrated in FIG. 9. In that drawing, a plurality of staples 90 are held by the staple remover 20 with the bridges 88 of the staples 90 positioned in the magazine 59 provided between the upper and lower prongs 52, 54 of the clip 26 so that the legs 92 of the staples 90 depend downwardly from the side edges of the lower prong 54 and they advantageously engage the side surfaces 68 and 70 of the head 24 to minimize the possibility of unintended escape of staples from the magazine. To remove collected staples from the magazine 59, the bridges 88 of the staples 90 may be collectively squeezed endwise between the thumb and index fingers of a user's hand and pulled out of the magazine 59 under the finger 62.

With reference to FIGS. 10*a* and 10*b*, an alternate embodiment of the staple remover involves the use of a clip 26' which is provided with shoulders 104 on its lower prong 54'. In this form of the clip 26', the width of the lower prong 54' is reduced in the area rearwardly of the shoulders 104 and is substantially equal to that of the upper prong 52' in the region of the upper prong 52' directly above the lower prong 54'. Also, as shown in FIG. 11, the passageway 40' in the handle 22' is modified so that it has a square or rectangular cross section as opposed to an I-shaped cross section with a width approximately equal to the width of the upper and lower prongs 52' and 54' to provide an interference fit of the side edges of the clip 26' in the passageway.

The clip 26' is further provided with relatively flat beveled surface 106 on the underside of the lower prong 54' adjacent the end edge 60'. The surface 106 preferably makes an angle of about 7.5° with the upper surface of this lower prong 54' and it reduces the thickness of the lower prong at its forwardmost point to about one half that of the remaining portion of the lower prong extending rearwardly from a back edge 108 of the surface. As shown in FIGS. 12*a* and 12*b*, the head 24' is preferably modified in this embodiment so that the end edge 42' is straight across and is substantially aligned with the back edge 108 of the beveled surface 106 on the lower prong 54' of the clip 26' to provide a relatively smooth transition between the surface 64' of the head 24' and the beveled surface. However, the end edge 60' of the lower prong 54' preferably retains a generally rounded configuration in this embodiment to facilitate insertion of the lower prong between a staple bridge and an object.

As shown in FIGS. 10*a*–10*b*, the projection 82' of the lower prong 54' may be rounded in configuration and in this case the associated detent 80' of the handle 22' (illustrated in outline in FIG. 10*a*) will preferably also be rounded to fittingly accept the projection 82.'

The clip 26' of the embodiment of FIGS. 10*a* through 12*b* may be inserted in the passageway 40' of the handle 22' from the front with the shoulders 104 engaging upon the front surface 33' of the handle 22' (illustrated in outline in FIG. 1*a*) substantially simultaneously with acceptance of the projection 82' by the detent 80'. This arrangement enables a relatively tight, secure fit of the clip 26' in the passageway 80' whereby longitudinal and sidewise movement of the clip relative to the handle is restricted. Front loading of the clip 26' is also advantageous in that it lends itself to mass production techniques so that manufacturing costs may be reduced.

Although several embodiments of the invention have been set forth in the foregoing detailed description, it will be understood that the invention is capable of numerous other modifications, replacements, rearrangements and additions without departing from the scope and spirit of the appended claims.

We claim:

1. A staple remover which comprises an elongate handle for enabling the gripping of the staple remover by a user, a head projecting from one end of the handle, a clip supported atop said head including an insertable portion for being supportably inserted beneath a staple to enable its removal from the object by the application of a force on said clip through the supporting head, said clip including means defining a magazine for storage of removed staples and gate means for permitting restricted entry of staples to said magazine as staples are undergoing a process of removal and restricting displacement of removed staples out of said magazine, said magazine-defining means and said gate means being integrally connected to said insertable portion as a one-piece unit to facilitate assembly of said staple remover.

2. A staple remover which comprises an elongate handle for enabling the gripping of the staple remover by a user, a head projecting from one end of the handle, a clip supported atop said head for being supportably inserted beneath a staple to enable its removal from the object by the application of a force on said clip through the supporting head, said clip including means defining a magazine for storage of removed staples and gate means for permitting restricted entry of staples to said magazine as staples are undergoing a process of removal and restricting displacement of removed staples out of said magazine; said clip being provided by a single piece of elongate, relatively thin, flat resilient metal folded over upon itself to provide upper and lower prongs which are jointed together at a bend and wherein said bend is received within a recess in said handle with the free ends of said upper and lower prongs projecting from said recess over said head, said lower prong supported on said head and said upper prong disposed in spaced, overlying relation to said lower prong and including finger means adjacent its free end for cooperating with said lower prong to provide said magazine and said gate means wherein said upper prong and its associated finger means resiliently yield away from said lower prong to accommodate the passage of staples into said magazine during a process of staple removal.

3. A staple remover for removing staples from an object comprising a plastic handle having an elongated gripping portion, a projecting head on a first end of said gripping portion, a passageway extending into said gripping portion from the exterior of said handle at a position adjacent said projecting head, said gripping portion and said head being integrally formed together as a unitary, one-piece construction, and a metallic clip having a first end which extends into said passageway so that said clip is supported on said handle, and having a second end which projects out of said passageway onto said head and which is configured to provide a projecting end for being urged under a staple to enable removal of the staple from the object by the application of a force through said clip from said handle, said clip being provided by a single, unitary construction and positioned upon the head so that during a staple removing process, the head prevents the clip from bending by an appreciable amount as the staple is pried loose with the staple remover.

4. A staple remover for removing staples from an object comprising a plastic handle having an elongated gripping portion, a projecting head on a first end of said gripping portion, a passageway extending into said gripping portion from the exterior of said handle at a position adjacent said projecting head, said gripping portion and said head being integrally formed together as a unitary, one-piece construction, and a metallic clip having a first end which extends into said passageway so that said clip is supported on said handle, and having a second end which projects out of said passageway onto said head and which is configured to provide a projecting end for being urged under a staple to enable removal of the staple from the object by the application of a force through said clip from said handle, said clip being provided by a single, unitary construction, and said staple remover further comprises means for lockably inserting said clip into said passageway from the exterior of said handle.

5. The staple remover of claim 4, wherein said lock means includes a projection on said clip and a detent in said handle adjacent said passageway wherein said projection snaps into said detent upon insertion of said clip into said passageway to thereby maintain said projecting end of said clip in position for use in removing staples as aforesaid.

6. A staple remover for use in the removal of staples from an object comprising a elongate handle for enabling a user to operatively grip the staple remover, a wedge-shaped head projecting from one end of the handle and having an upper surface, a passageway in the handle and opening therefrom adjacent said upper surface of said head, a clip received in the passageway in the handle and having upper and lower prongs projecting from said passageway over said upper surface of said head, said lower prong being supported on said head and having an outboard end edge for insertion between the bridge of a staple and the surface of the object to facilitate removal of the staple therefrom and said upper prong overlying said lower prong in spaced apart relation thereto to provide a staple collecting magazine between said upper and lower prongs, and a finger located on said upper prong of said clip at a position rearwardly spaced from said end edge of said lower prong and disposed closely adjacent to said lower prong to engage and restrict passage of the bridge of a staple therebetween, said upper prong of said clip being resiliently deflectable away from said lower prong in response to a force urging said finger against the bridge of the staple so as to permit the staple to enter said magazine.

7. The staple remover of claim 6, wherein the spacing of said finger from said end edge of said lower prong is such that said finger has been fully displaced by the bridge of a passing staple and is at least beginning a return toward its resting position adjacent the surface of the lower prong when the staple has been fully loosened from the object and is entering said magazine.

8. A staple remover for removing a U-shaped staple from a stapled object comprising:

means providing an elongated handle adapted to be grasped by the hand of a user and an integrally formed wedge-shaped head projecting from one end of the handle;

a clip supported on said handle and having an upper and a lower prong, said lower prong supported on said head and having an upper surface, an outboard end edge, and two opposite side edges which extend rearwardly of the lower prong from the end edge thereof so that said end edge may be urged between a staple and a stapled object for removing the staple from the stapled object wherein the bridge of the removed staple extends across said lower prong with the legs depending from said side edges thereof; and said upper prong of said clip overlying said upper surface of said lower prong in spaced relation to provide a staple storage magazine therebetween and having a finger adjacent an outboard end thereof which is disposed closely adjacent to said upper surface of said lower prong so as to engage the bridge of staple undergoing a process of removal from the object by said edge of said lower prong between a staple and a stapled object, and said upper prong resiliently yielding in response to the aforesaid urging to cause said finger to move away from said lower prong to permit movement of the bridge of the staple along said lower prong past said finger and into said magazine.

9. The staple remover of claim 8 wherein the width of said head beneath said lower prong adjacent said magazine is such that the legs of removed staples which depend from said side edges of said lower prong engage said head to restrict movement of staples in said magazine.

10. The staple remover of claim 8 wherein said lower prong is shaped so that its opposite side edges diverge away from one another as a path is traced rearwardly along the lower prong from the end edge thereof.

11. The staple remover of claim 8 wherein the upper surface of said lower prong is substantially planar.

12. The staple remover of claim 8 wherein said handle includes a forwardly-opening recess, said upper and lower prongs of said clip being joined together at a bend in said clip which is received within said forwardly-opening recess of said handle so that said upper and lower prongs project from said recess over said head.

13. The staple remover of claim 8 wherein said upper and lower prongs are integrally formed from a single piece of spring metal bent over upon itself at a bend to provide said clip.

14. The staple remover of claim 8 wherein said head is provided with a bearing surface that is sloped with respect to said upper surface of said lower prong so that as said bearing surface is applied to the surface of the stapled object, the lower prong is maintained in an angular relationship with the surface of the stapled object.

15. The staple remover of claim 14 wherein said bearing surface terminates forwardly at an end edge which is disposed closely adjacent said end edge of said lower prong and spaced slightly rearwardly thereof so that said lower prong projects slightly beyond said end edge of said head.

16. The staple remover of claim 14 wherein said bearing surface and the upper surface of said lower prong form an acute angle of about thirty degrees

* * * * *

UNITED STATES PATENT AND TRADEMARK OFFICE

CERTIFICATE OF CORRECTION

PATENT NO. : 5,090,663

DATED : February 25, 1992

INVENTOR(S) : H. Carl Crutchfield, et al

It is certified that error appears in the above-identified patent and that said Letters Patent is hereby corrected as shown below:

IN THE ABSTRACT line 15, "into" should be --onto--.

Column 2, line 55, "313 3" should be --3-3--.

Column 7, line 61, "1a" should be --10a--.

Signed and Sealed this

Twenty-second Day of June, 1993

*Attest:*

Michael K. Kirk

MICHAEL K. KIRK

*Attesting Officer*

*Acting Commissioner of Patents and Trademarks*